US011122864B2

(12) United States Patent
Recchi

(10) Patent No.: US 11,122,864 B2
(45) **Date of Patent: *Sep. 21, 2021**

(54) FOOTWEAR WITH DUAL SHANKS

(71) Applicant: Rocky Brands, Inc., Nelsonville, OH (US)

(72) Inventor: Mark S. Recchi, Lancaster, OH (US)

(73) Assignee: Rocky Brands, Inc., Nelsonville, OH (US)

( * ) Notice: Subject to any disclaimer, the term of this patent is extended or adjusted under 35 U.S.C. 154(b) by 70 days.

This patent is subject to a terminal disclaimer.

(21) Appl. No.: 16/722,450

(22) Filed: Dec. 20, 2019

(65) Prior Publication Data

US 2020/0315297 A1 Oct. 8, 2020

Related U.S. Application Data

(63) Continuation of application No. 16/377,310, filed on Apr. 8, 2019, now Pat. No. 10,517,353.

(51) Int. Cl.
*A43B 23/22* (2006.01)
*A43B 7/14* (2006.01)

(52) U.S. Cl.
CPC ..... *A43B 23/22* (2013.01); *A43B 7/1425* (2013.01)

(58) Field of Classification Search
CPC ..... A43B 23/22; A43B 23/222; A43B 7/1425
See application file for complete search history.

(56) References Cited

U.S. PATENT DOCUMENTS

| | | | | |
|---|---|---|---|---|
| 881,974 | A * | 3/1908 | Toporczer | A43B 7/142 36/179 |
| 1,879,729 | A * | 9/1932 | Brown | A43B 23/22 36/155 |
| 7,299,567 | B2 * | 11/2007 | Berend | A43B 7/142 36/107 |
| 7,380,353 | B2 * | 6/2008 | Feller | A43B 1/0072 36/108 |
| 7,421,808 | B2 * | 9/2008 | Baier | A43B 13/12 36/107 |
| 9,144,265 | B2 * | 9/2015 | Lubart | A43B 3/0073 |
| 9,591,891 | B1 * | 3/2017 | Baucom | A43B 5/02 |
| 10,517,353 | B1 * | 12/2019 | Recchi | A43B 13/14 |
| 2002/0062578 | A1 * | 5/2002 | Lussier | A43B 13/14 36/59 R |
| 2012/0186106 | A1 * | 7/2012 | Recchi | A43B 23/047 36/102 |

* cited by examiner

*Primary Examiner* — Ted Kavanaugh
(74) *Attorney, Agent, or Firm* — Porter, Wright, Morris & Arthur LLP

(57) ABSTRACT

Footwear for covering a foot of a wearer includes an outsole configured for supporting the foot of the wearer, an upper secured to the outsole and configured for covering the foot of the wearer, an insole located above the outsole within the upper, a midsole located above the outsole and below the insole and first and second laterally adjacent shanks located above the outsole and below the insole. The first shank angles forward and outward from the heel portion to a lateral side of the middle portion and the second shank angles forward and outward from the heel portion to a medial side of the middle portion to form an acute angle therebetween and provide balance and torsional stability for sides of the wearer's foot.

10 Claims, 8 Drawing Sheets

FOOTWEAR WITH DUAL SHANKS

CROSS-REFERENCE TO RELATED APPLICATIONS

This application is a continuation application of U.S. patent application Ser. No. 16/377,310 filed on Apr. 8, 2019, the disclosure of which is expressly incorporated herein in its entirety by reference.

STATEMENT REGARDING FEDERALLY SPONSORED RESEARCH

Not Applicable

PARTIES TO JOINT RESEARCH AGREEMENT

Not Applicable

REFERENCE TO APPENDIX

Not Applicable

FIELD OF THE INVENTION

The field of the present invention generally relates to footwear and, more particularly, to footwear including a shank for providing support for the wearer's foot.

BACKGROUND OF THE INVENTION

Certain types of footwear such as, for example, western or cowboy boots, work boots, and the like are typically manufactured with a relatively durable construction in order to withstand the adverse conditions in which they are typically worn. This durable construction can also provide desired support for the wearer's foot as it reduces undesirable twisting and bending of the footwear in unwanted directions during use. When constructed in this manner, however, the footwear can be relatively heavy which can result in wearer fatigue as well as making it more difficult to walk for some wearers under some conditions. As a result, there has been a long standing desire to reduce weight while at the same time maintaining durability and support of the feet.

The most common attempt to remedy this problem has been to provide footwear with an outsole constructed of lighter weight materials along with a shank, comprising a rigid material such steel, extending lengthwise down the middle of the outsole at the top of the outsole. While these attempts are somewhat effective, they still do not provide full support for the wearer's feet. Accordingly, there is a need for improved footwear that has increased support for the wearer's feet without a substantial increase in weight.

SUMMARY OF THE INVENTION

Disclosed are footwear that overcome at least one of the disadvantages of the prior art described above. Disclosed is footwear for covering a foot of a wearer. The footwear comprises an outsole configured for supporting the foot of the wearer, an upper secured to the outsole and configured for covering the foot of the wearer, an insole located above the outsole within the upper, a midsole located between the outsole and the insole, and first and second laterally adjacent shanks located above the outsole and below the insole. The outsole has a heel portion at a rear end, a toe portion at front end opposite the heel portion, and a middle portion between the heel portion and the toe portion The first shank angles forward and outward from the heel portion to a lateral side of the middle portion and the second shank angles forward and outward from the heel portion to a medial side of the middle portion to form an acute angle therebetween and provide balance and torsional stability for sides of the wearer's foot.

Also disclosed is footwear for covering a foot of a wearer comprising an outsole configured for supporting the foot of the wearer, an upper secured to the outsole and configured for covering the foot of the wearer, an insole located above the outsole within the upper, a midsole located between the outsole and the insole, and first and second laterally adjacent shanks located above the outsole and below the insole. The outsole has a heel portion at a rear end, a toe portion at front end opposite the heel portion, and a middle portion between the heel portion and the toe portion. The first shank angles forward and outward from near a lateral center of the heel portion to a lateral side of the middle portion and the second shank angles forward and outward from near a lateral center of the heel portion to a medial side of the middle portion to form an acute angle therebetween and provide balance and torsional stability for sides of the wearer's foot. Rear ends of the first and second shanks are closer in a lateral direction than front ends of the first and second shanks in the lateral direction.

Also disclosed is a western boot for covering a foot of a wearer. The western boot comprises an outsole configured for supporting the foot of the wearer, an upper secured to the outsole and configured for covering the foot of the wearer, an insole located above the outsole within the upper, a midsole located between the outsole and the insole, and first and second laterally adjacent shanks located above the outsole and below the insole. The outsole has a heel portion at a rear end, a toe portion at front end opposite the heel portion, and a middle portion between the heel portion and the toe portion. The upper has an unlaced shaft configured to cover the lower leg of the wearer. The first shank angles forward and outward from near a lateral center of the heel portion to a lateral side of the middle portion and the second shank angles forward and outward from near a lateral center of the heel portion to a medial side of the middle portion to form an acute angle therebetween and provide balance and torsional stability for sides of the wearer's foot. Rear ends of the first and second shanks are closer in a lateral direction than front ends of the first and second shanks in the lateral direction.

From the foregoing disclosure and the following more detailed description of various preferred embodiments it will be apparent to those skilled in the art that the present invention provides a significant advance in the technology and art of footwear. Particularly significant in this regard is the potential the invention affords for providing a relatively lightweight construction and while being durable and having improved support for the wearer's foot. Additional features and advantages of various preferred embodiments will be better understood in view of the detailed description provided below.

BRIEF DESCRIPTION OF THE DRAWINGS

These and further features of the present invention will be apparent with reference to the following description and drawings, wherein.

Figure 1:
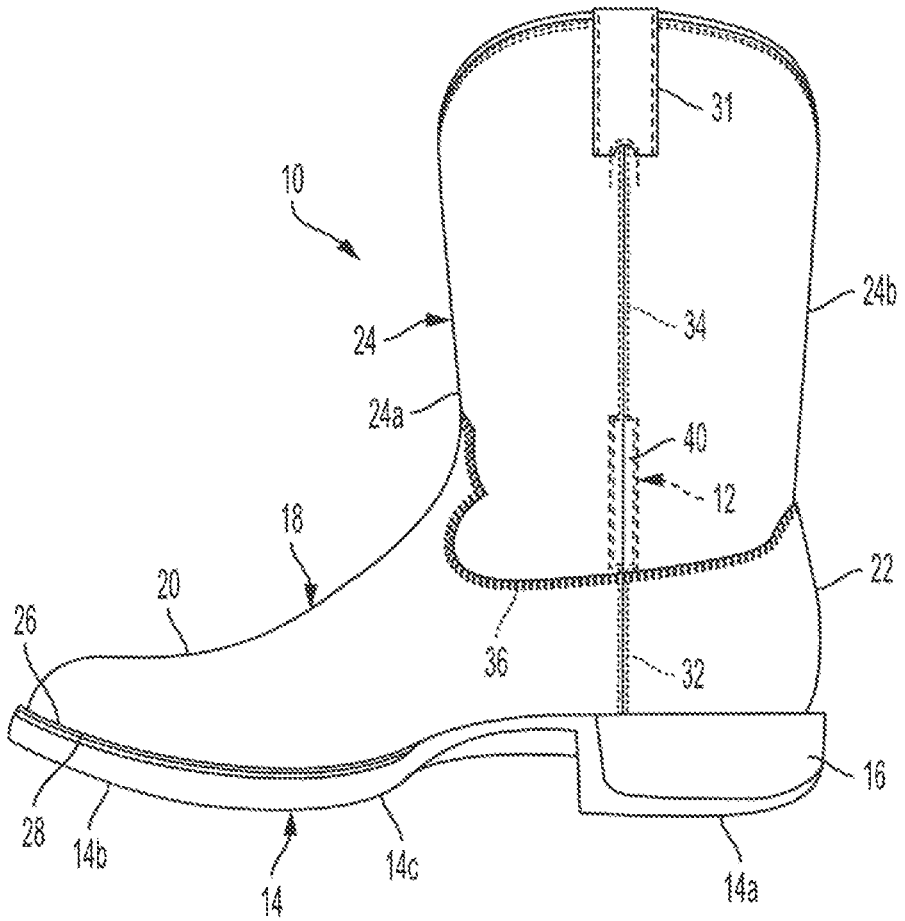
FIG. 1 is a side elevational view of footwear for a left foot of a wearer according to a first embodiment of the present invention.
Figure 2:
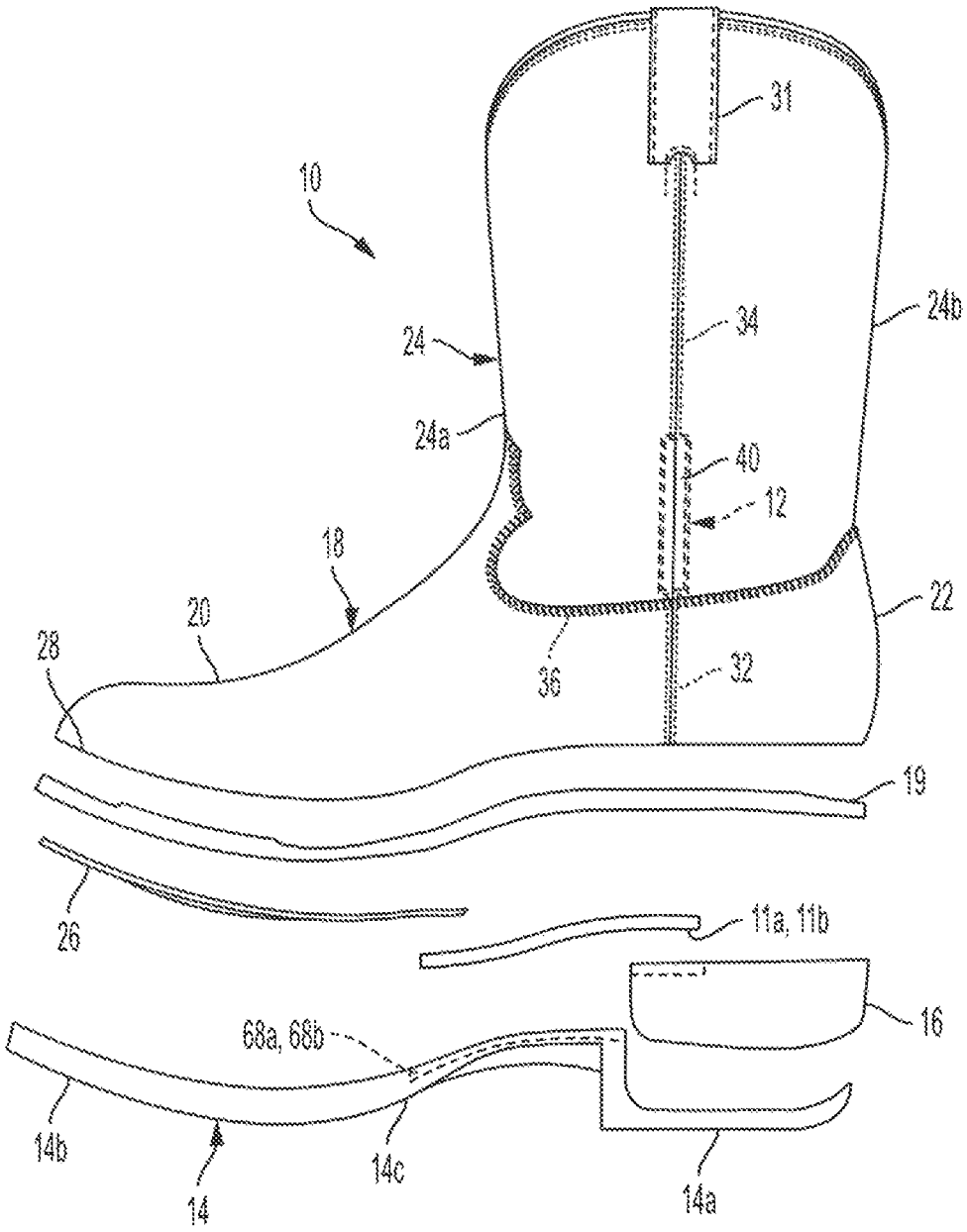
FIG. 2 is an exploded elevational view of the footwear of FIG. 1.
Figure 3:
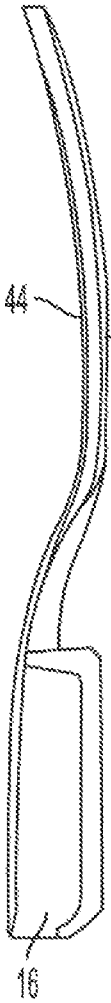
FIG. 3 is a right side elevational view of an outsole of the footwear of FIGS. 1 and 2.
Figure 4:
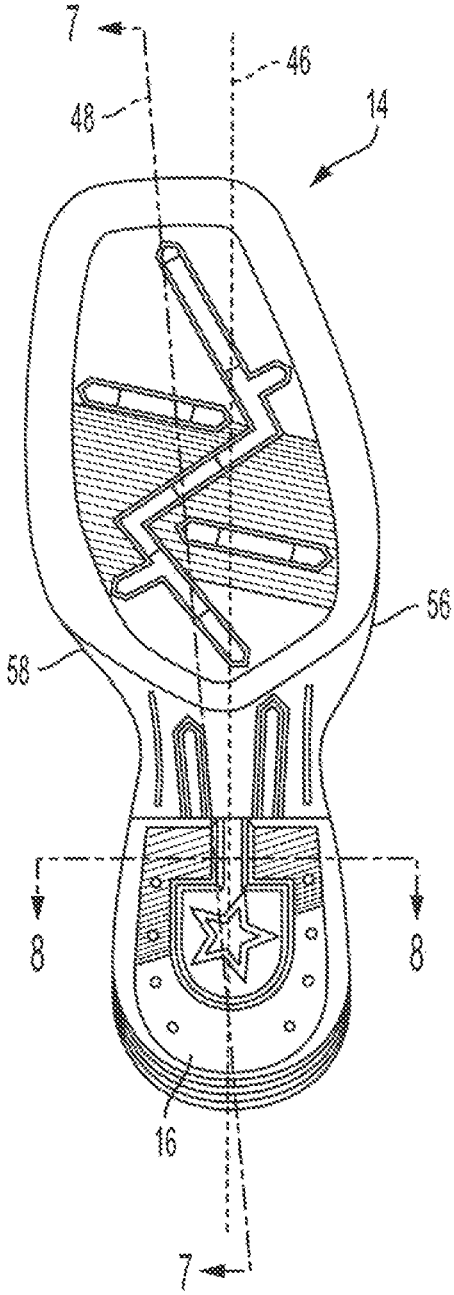
FIG. 4 is a bottom plan view of the outsole of FIG. 3.
Figure 5:
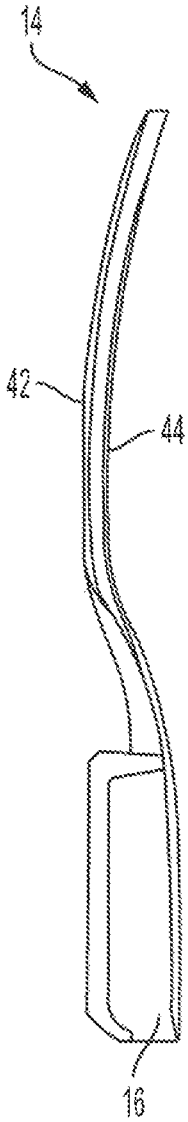
FIG. 5 is a left side elevational view of the outsole of FIGS. 3 and 4.

It should be understood that the appended drawings are not necessarily to scale, presenting a somewhat simplified representation of various preferred features illustrative of the basic principles of the invention. The specific design features of the footwear as disclosed herein, including, for example, specific dimensions, orientations, locations, and shapes of the various components, will be determined in part by the particular intended application and use environment. Certain features of the illustrated embodiments have been enlarged or distorted relative to others to facilitate visualization and clear understanding. In particular, thin features may be thickened, for example, for clarity or illustration. All references to direction and position, unless otherwise indicated, refer to the orientation of the footwear illustrated in the drawings. In general, up or upward generally refers to an upward direction within the plane of the paper in FIG. 1 and down or downward generally refers to a downward direction within the plane of the paper in FIG. 1. Also in general, front or forward generally refers to a direction toward the left within the plane of the paper in FIG. 1 and rear or rearward generally refers to a direction toward the right within the plain of the paper in FIG. 1.

DETAILED DESCRIPTION OF CERTAIN PREFERRED EMBODIMENTS

It will be apparent to those skilled in the art, that is, to those who have knowledge or experience in this area of technology, that many uses and design variations are possible for the footwear disclosed herein. The following detailed discussion of various alternative and preferred embodiments will illustrate the general principles of the invention with regard to a western-style boot. Other embodiments of the present invention suitable for other applications will be apparent to those skilled in the art given the benefit of this disclosure. For example, the present invention is suitable for other types of footwear such as, for example, work boots, shoes, and the like.

Referring now to the drawings, FIGS. 1 to 10 show a western-style boot 10 having first and second or left and right shanks 11*a*, 11*b* for improving support for the wearer's foot according to a first embodiment of the present invention. The illustrated boot 10 is adapted for use on a left foot but it is noted that a similar but mirror image boot adapted for the right foot is used in conjunction with the illustrated boot 10 for form a pair of the boots 10 for the wearer's left and right feet. The illustrated boot 10 includes an outsole or sole 14 configured for supporting the foot of the wearer and having a heel 16 at a heel portion 14*a* at a rear end, a toe portion 14*b* at front end opposite the heel portion 14*a*, and a middle portion 14*c* between the heel portion 14*a* and the toe portion 14*c*, an upper 18 secured to the outsole 14 and extending upward from the outsole 14 for covering the foot of the wearer and a portion of their lower leg, an insole 19 located above the outsole 14 and within the upper 18, and the first and second laterally adjacent shanks 11*a*, 11*b* located at the outsole 14 and below the insole 19.

The illustrated outsole 14 forms an exterior bottom surface 42 for the boot 10 and an interior top surface 44 for supporting the insole 19 located above the outsole 14. The outsole 14 is the outermost portion of the outsole 14 of the boot 10 and forms the bottom surface 42 of which is exposed to wear. The illustrated outsole 14 is molded of synthetic material but can alternatively comprise any other suitable material such as, for example, leather and the like. It is noted that the outsole 14 can alternatively have any other suitable construction within the scope of the present invention. For example, the outsole 14 can include one or more midsoles between the illustrated outsole 14 and the insole 19. The midsole is designed to provide the boot 10 with other desired characteristics of cushioning, support, and flexibility etc.

The illustrated upper 18 includes a vamp 20 which covers the top and front portion of the wearer's foot, a counter 22 that encloses the heel and rear portion of the wearer's foot and is secured to the rear end of the vamp 20, and a shaft 24 which fits around the lower shin of the wearer and is secured to the top of the vamp and counter 20, 22. The illustrated shaft 24 comprises forward and rearward portions 24*a*, 24*b* that together form a cylindrical shape that encircles the lower portion of the wearer's leg. The shaft 24 also has an upper edge which forms an upper opening through which the wearer's foot enters the boot 10. The illustrated shaft 24 includes pull tabs or loops 31 located near the upper edge on opposed lateral sides of the shaft 24 which allow for ease in pulling on the boot 10 by putting fingers through the pull tabs 31. The illustrated vamp 20 and shaft 24 are continuous in that they are "unlaced". That is, they are not provided with any type openings which are selectively closed by fasteners such as laces, zippers, buttons, hooks and the like to tighten the vamp 20 and/or shaft 24 to secure the footwear to the users The illustrated components 20, 22, 24 of the upper 18 comprise leather such as, for example, cowhide, pigskin, horsehide, kangaroo skin, and the like but any other suitable material can alternatively be utilized such as, for example exotic leathers or skins, synthetic materials, and the like. It is noted that the upper 18 can alternatively have any other suitable construction within the scope of the present invention.

The illustrated upper 18 also includes an expansion joint 12 which is a "stretch seam" located along the seam 34 between the forward and rearward portions 24*a*, 24*b* of the shaft 24. That is, the illustrated slit 40 is formed by not securing a portion of the shaft portions 24*a*, 24*b* together as they are otherwise rigidly secured together. Thus, the seam 34 can stretch open at the slit 40 when the wearer's foot is passing therethrough. It is noted that by utilizing such a stretch seam, the expansion joint 12 is relatively unnoticeable during normal wearing except for the different stitching at the expansion joint 12. It is noted that the expansion joint 12 can alternatively have other suitable construction or can be eliminated if desired.

The illustrated components 20, 22, 24 of the upper 18 are secured together by stitching but any other suitable means can alternatively be utilized. The illustrated vamp and counter 20, 22 are secured together at substantially vertical stitched seams 32 on opposed lateral sides of the upper 18. The illustrated portions 24*a*, 24*b* of the shaft 24 are secured together at substantially vertical stitched seams 34 on opposed lateral sides of the upper 18 which are aligned with the seams 32 of the vamp 20 and counter 22 such that they appear to be vertical extensions thereof. The illustrated shaft 24 is secured to the vamp and counter 20, 22 with generally horizontal stitched seams 36 at the interfaces. It is noted that the upper 18 can also comprise a lining within its interior. The lining typically comprises pigskin, glove leathers, a heavy twilled cotton or linen fabric, and the like. Additionally, the lining can comprise synthetics such as, for example, Gortex, Sympatex, and the like to provide waterproof and/or sweat dissipating characteristics to the boot 10.

The illustrated bottom edge of the upper 18 is secured to the outsole 14 with a welted construction where the upper 18 is stitched to the outsole 14 using a welt 26. The welt 26 is a strip of leather or synthetic material which extends about the periphery of the upper 18 at the interface with the outsole 14. The vamp and counter 20, 22 are stitched to the welt 26 and the welt 26 is in turn stitched to the outsole 14. It is noted that upper 18 can alternatively be secured to the outsole 14 using any other suitable construction such as, for example, a cemented construction where the upper 18 is glued to the outsole 14 with adhesive or a combination of the constructions.

The insole 19 forms the upper most interior surface on the inside of the illustrated boot 10. A removable footbed (not shown) that is cushioned and/or contoured can optionally sit directly on top of the insole 19 if desired. The insole 19 is attached directly to the boot upper 18. The illustrated insole 19 is molded of synthetic material but can alternatively comprise any other suitable material. The insole 19 can optionally include foam and a sock lining cover when a removable footbed is not utilized on top of the insole 19.

The illustrated first and second laterally adjacent shanks 11*a*, 11*b* are located at the top surface 44 of the outsole 14 and below the insole 19. The first and second shanks 11*a*, 11*b* forwardly extend from the heel portion 14*a* of the outsole 14 to the middle portion 14*c* of the outsole 14. The first and second shanks 11*a*, 11*b* form an acute-angle therebetween about the heel centerline 46. It is noted that the illustrated heel centerline 46 is also at an angle to the last centerline 48. The illustrated first and second shanks 11*a*, 11*b* form an acute-angle of about 10 degrees but any other suitable acute angle and length of the shanks 11*a*, 11*b* can be utilized in order to locate the front and rear ends 52, 54 of the shanks 11*a*, 11*b* at desired locations. The first and second shanks 11*a*, 11*b* angle outward from near a lateral center of the heel portion 14*a* of the outsole 14 toward lateral and medial sides of the middle portion 14*c* of the outsole 14. The rear ends 54 of the first and second shanks 11*a*, 11*b* are closer to each other in a lateral direction than the front ends 52 of the first and second shanks 11*a*, 11*b* in the lateral direction. Thus, the front ends 52 of the first and second shanks 11*a*, 11*b* are located at or near a position to be under outer balls of the wearer's foot near lateral sides 56, 58 of the outsole 14. Configured in this manner the first and second shanks 11*a*, 11*b* provide balance and torsional stability for sides of the wearer's foot. The first and second shanks 11*a*, 11*b* comprise a suitable material that supports the wearer's foot and the weight of the wearer. Typically, this material has a rigidity substantially greater than the material of the outsole 14. The first and second shanks 11*a*, 11*b* can comprise at least one of fiberglass, steel, nylon, and the like.

The illustrated first and second shanks 11*a*, 11*b* are separate spaced-apart and are formed as identical components. It is noted that the first and second shanks 11*a*, 11*b* can alternatively be secured together or formed as a single component if desired. It is also noted that the first and second shanks 11*a*, 11*b* can alternatively be formed with different configurations and/or different materials if desired to provide different support characteristics near the different lateral sides 56, 58 of the outsole 14.

Figure 9:
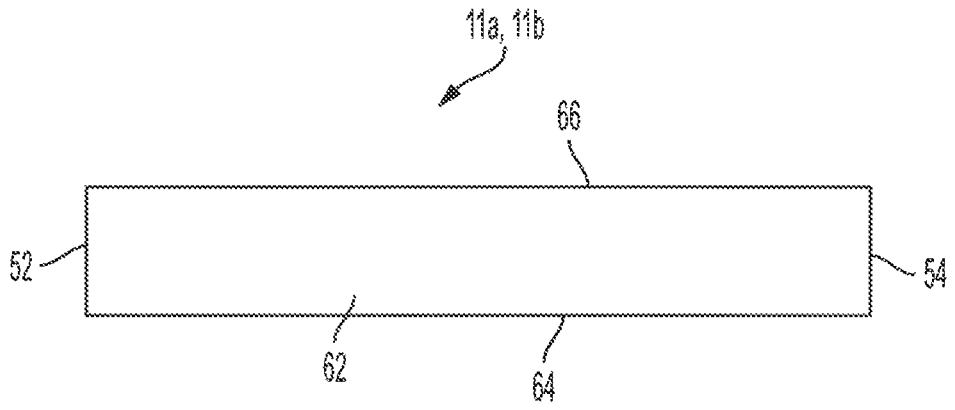
FIG. 9 is a top plan view of one of the first and second shanks of the footwear of FIGS. 1 and 2.
Figure 10:
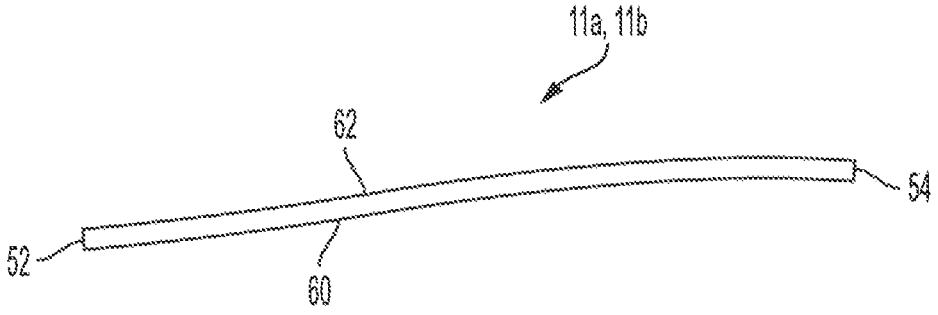
FIG. 10 is a left-side elevational view of one of the shank of FIG. 9.

As best shown in FIGS. 9 and 10, each of the first and second shanks 11*a*, 11*b* is a generally elongate rectangular-shaped strip having a length that is substantially longer than the width, and a width that is substantially longer than the thickness. The illustrated shanks 11*a*, 11*b* have a length of about 4.5 inches, a width of about 11/16 inches, and a thickness of about 1/16 inches. But it is noted that any other suitable dimensions can alternatively be utilized. The dimensions along with the material of the shank 11*a*, 11*b* are selected to position the ends 52, 54 of the shank 11*a*, 11*b* at the desired locations and to provide the shank 11*a*, 11*b* with the desired properties such as rigidity. The illustrated shank 11*a*, 11*b* has a bottom surface 60 to be secured to the outsole 14, an opposed top surface 62 to be engaged by the insole 19, left and right opposed sides or edges 64, 66 extending between the bottom and top surfaces 60, 62, and the front and rear opposed ends or edges 52, 54 extending between the bottom and top surfaces 60, 62. The illustrated shank 11*a*, 11*b* is shaped in the lengthwise direction to closely conform to the shape of the upper surface 44 of the outsole 14. The illustrated shank 11*a*, 11*b* is generally "s-shaped" when viewed from the lateral side to account for the top surface 44 of the heel portion 14*a* of the outsole 14 being higher than the top surface 44 of the middle portion 14*c* of the outsole 14. It is noted that the shank 11*a*, 11*b* can alternatively have any other suitable shape or configuration.

Figure 6:
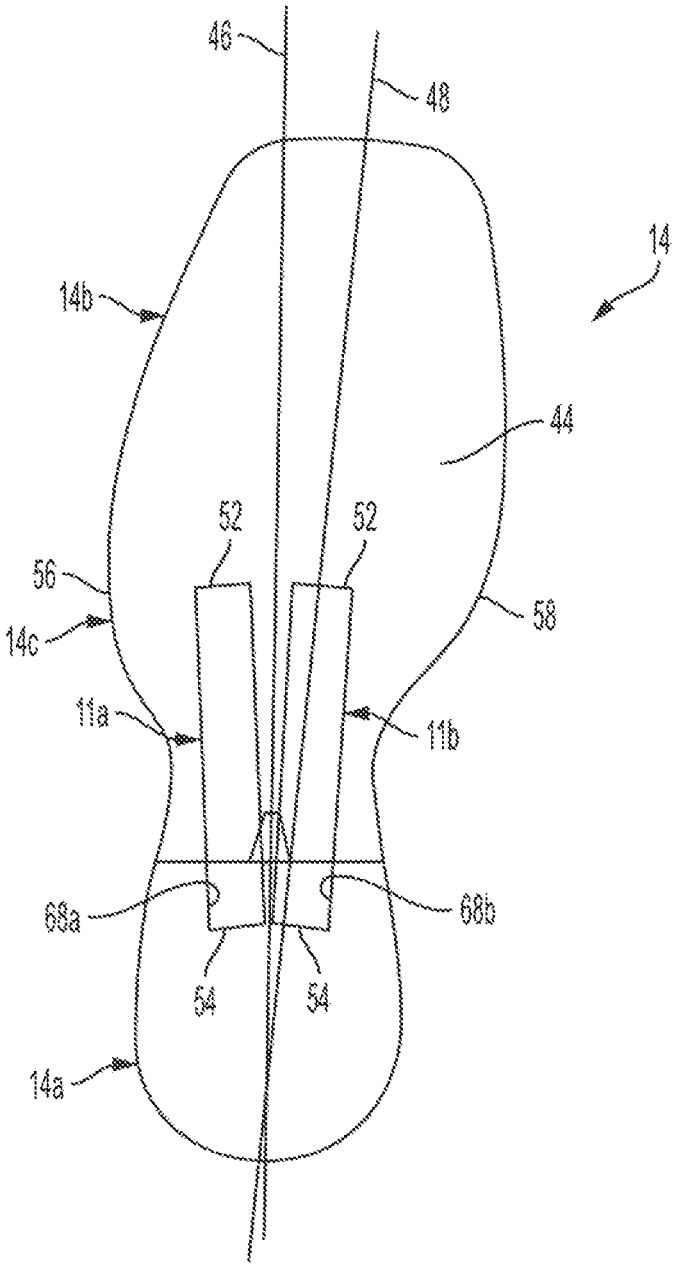
FIG. 6 is a top plan view of the outsole of FIGS. 3 to 5.
Figure 7:
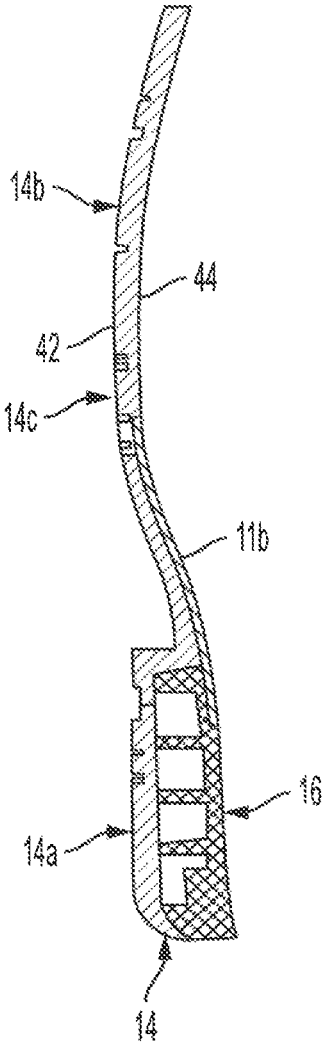
FIG. 7 is a cross sectional view taken along line 7-7 of FIG. 4, wherein first and second shanks are secured to the outsole.
Figure 8:
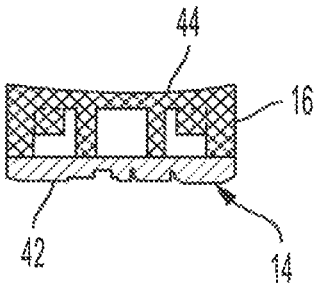
FIG. 8 is a cross sectional view taken along line 8-8 of FIG. 4.

As best seen in FIGS. 6 and 7, first and second separate and spaced-apart pockets or recesses 68*a*, 68*b* having open tops are formed in the top surface 44 of the outsole 14 for receiving the first and second shanks 11*a*, 11*b* therein. The pockets 68*a*, 68*b* are preferably rectangular-shaped to closely receive the first and second shanks 11*a*, 11*b* and locate and hold the shanks as the desired shank positions discussed above. The pockets 68*a*, 68*b* preferably have a depth substantially the same as the thickness of the first and second shanks 11*a*, 11*b* such that the top surfaces 62 of the first and second shanks 11*a*, 11*b* are substantially flush or level with the top surface 44 of the outsole 14. The first and second shanks 11*a*, 11*b* can be secured to the outsole 14 within the pockets 68*a*, 68*b*, in any suitable manner such as, for example, by adhesive or the like. Configured in this manner, the first and second shanks 1I a, 11*b* do not interfere with the insole 19 at the tope surface 44 of the outsole 14. It is noted however, that any other suitable configuration can alternatively be utilized such, as, for example, the shanks 11*a*, 11*b* can be embedded within the outsole 14, or the like.

Figure 11:
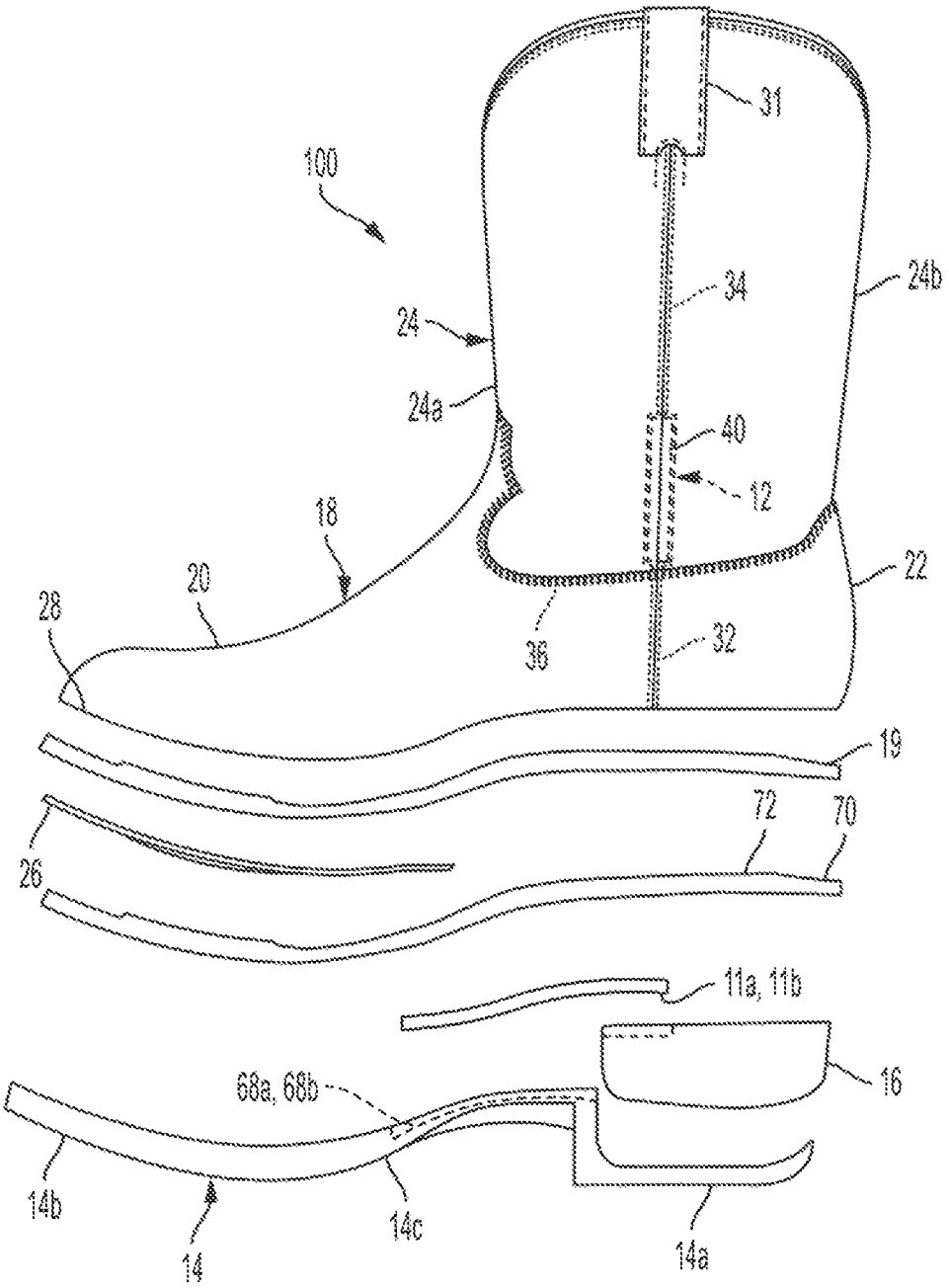
FIG. 11 is an exploded view of footwear similar to FIG. 2 but according to a second embodiment of the present invention.

FIG. 11 shows a western-style boot 100 having first and second or left and right shanks 11*a*, 11*b* for improving support for the wearer's foot according to a second embodiment of the present invention. The boot 100 according to the second embodiment of the present invention is substantially the same as the boot 10 according to first embodiment of the invention described above except that a midsole 70 is provided between the outsole 14 and the insole 19. Therefore, the first and second shanks 11*a*, 11*b* are located below the midsole 70 and between the outsole 14 and the midsole 70. The midsole 70 is designed to provide the boot 100 with desired characteristics of cushioning, support, and flexibility etc. and can comprise any suitable material such as, for example, EVA (ethylene vinyl acetate) and the like.

Figure 12:
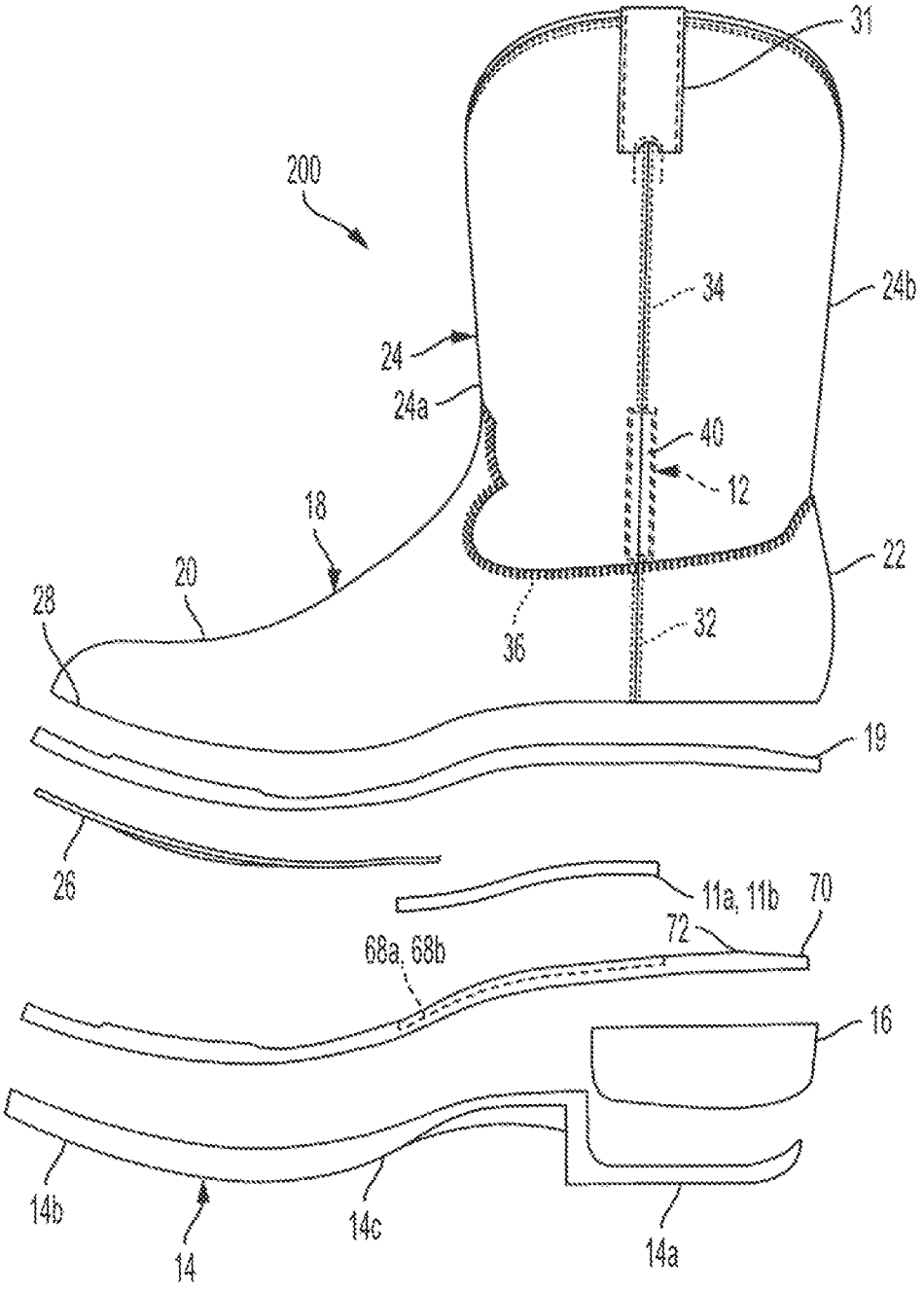
FIG. 12 is an exploded view of footwear similar to FIGS. 2 and 11 but according to a third embodiment of the present invention.

FIG. 12 shows a western-style boot 200 having first and second or left and right shanks 11*a*, 11*b* for improving support for the wearer's foot according to a third embodiment of the present invention. The boot 200 according to the third embodiment of the present invention is substantially the same as the boot 100 according to second embodiment of the invention described above except that the first and second shanks 11*a*, 11*b* are located above the midsole 70 and between the midsole 70 and the insole 19. Accordingly, the first and second separate and spaced-apart pockets or recesses 68*a*, 68*b* are formed in the top surface 72 of the midsole 70 for receiving the first and second shanks 11*a*, 11*b* therein. Configured in this manner, the first and second shanks 11*a*, 11*b* do not interfere with the insole 19 at the tope surface 72 of the midsole 70.

Any of the features or attributes of the above the above described embodiments and variations can be used in combination with any of the other features and attributes of the above described embodiments and variations as desired.

It is apparent from the forgoing disclosure and detailed description that the present invention is effective to improve support of the wearer's foot. In particular, the dual shanks provide balance and torsional stability for sides of the wearer's foot unlike prior single shank footwear.

From the foregoing disclosure and detailed description of certain preferred embodiments, it is also apparent that various modifications, additions and other alternative embodiments are possible without departing from the true scope and spirit of the present invention. The embodiments discussed were chosen and described to provide the best illustration of the principles of the present invention and its practical application to thereby enable one of ordinary skill in the art to utilize the invention in various embodiments and with various modifications as are suited to the particular use contemplated. All such modifications and variations are within the scope of the present invention as determined by the appended claims when interpreted in accordance with the benefit to which they are fairly, legally, and equitably entitled.

What is claimed is:

1. Footwear for covering a foot of a wearer, said footwear comprising, in combination:

an outsole configured for supporting the foot of the wearer and having a heel portion at a rear end, a toe portion at front end opposite the heel portion, and a middle portion between the heel portion and the toe portion;

an upper secured to the outsole and configured for covering the foot of the wearer;

an insole located above the outsole within the upper;

a midsole located between the outsole and the insole;

first and second laterally adjacent shanks located above the outsole and below the insole, wherein the first and second shanks are located between the outsole and the midsole; and wherein the first shank angles forward and outward from the heel portion to a lateral side of the middle portion and the second shank angles forward and outward from the heel portion to a medial side of the middle portion to form an acute angle therebetween and provide balance and torsional stability for side of the wearer's foot, and wherein the first and second shanks are separate spaced-apart components.

2. The footwear according to claim 1, wherein rear ends of the first and second shanks are closer in a lateral direction than front ends of the first and second shanks in the lateral direction.

3. The footwear according to claim 1, wherein the front end of the second shank is located at a position configured to be under a ball of the wearer's foot.

4. The footwear according to claim 1, wherein first and second pockets are formed in a top surface of the outsole for receiving the first and second shanks therein.

5. Footwear for covering a foot of a wearer, said footwear comprising, in combination:

an outsole configured for supporting the foot of the wearer and having a heel portion at a rear end, a toe portion at front end opposite the heel portion, and a middle portion between the heel portion and the toe portion;

an upper secured to the outsole and configured for covering the foot of the wearer;

an insole located above the outsole within the upper;

a midsole located between the outsole and the insole;

first and second laterally adjacent shanks located above the outsole and below the insole, wherein the first and second shanks are located between the outsole and the midsole;

wherein the first shank angles forward and outward from near a lateral center of the heel portion to a lateral side of the middle portion and the second shank angles forward and outward from near a lateral center of the heel portion to a medial side of the middle portion to form an acute angle therebetween and provide balance and torsional stability for sides of the wearer's foot; and wherein rear ends of the first and second shanks are closer in a lateral direction than front ends of the first and second shanks in the lateral direction, and wherein the first and second shanks are separate spaced-apart components.

6. The footwear according to claim 5, wherein the front end of the second shank is located at a position configured to be under a ball of the wearer's foot.

7. The footwear according to claim 5, wherein first and second pockets are formed in a top surface of the outsole for receiving the first and second shanks therein.

8. A western boot for covering a foot of a wearer, said western boot comprising, in combination:

an outsole configured for supporting the foot of the wearer and having a heel portion at a rear end, a toe portion at front end opposite the heel portion, and a middle portion between the heel portion and the toe portion;

an upper secured to the outsole and configured for covering the foot of the wearer;

wherein the upper has an unlaced shaft configured to cover the lower leg of the wearer;

an insole located above the outsole within the upper;

a midsole located between the outsole and the insole;

first and second laterally adjacent shanks located above the outsole and below the insole, wherein the first and second shanks are located between the outsole and the midsole; and wherein the first shank angles forward and outward from near a lateral center of the heel portion to a lateral side of the middle portion and the second shank angles forward and outward from near a lateral center of the heel portion to a medial side of the middle portion to form an acute angle therebetween and provide balance and torsional stability for sides of the wearer's foot; and wherein rear ends of the first and second shanks are closer in a lateral direction than front ends of the first and second shanks in the lateral direction, and wherein the first and second shanks are separate spaced-apart components.

9. The western boot according to claim 8, wherein the front end of the second shank is located at a position configured to be under a ball of the wearer's foot.

10. The western boot according to claim 8, wherein first and second pockets are formed in a top surface of the outsole for receiving the first and second shanks therein.

* * * * *